US010025258B2

(12) United States Patent
Sejima et al.

(10) Patent No.: US 10,025,258 B2
(45) Date of Patent: Jul. 17, 2018

(54) IMAGE FORMING APPARATUS

(71) Applicant: KYOCERA Document Solutions Inc., Osaka (JP)

(72) Inventors: Hajime Sejima, Osaka (JP); Yoshiaki Tashiro, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/489,025

(22) Filed: Apr. 17, 2017

(65) Prior Publication Data

US 2017/0315497 A1 Nov. 2, 2017

(30) Foreign Application Priority Data

Apr. 27, 2016 (JP) ..... 2016-089288

(51) Int. Cl.
*G03G 15/00* (2006.01)
*G03G 21/16* (2006.01)

(52) U.S. Cl.
CPC ..... *G03G 21/1619* (2013.01)

(58) Field of Classification Search
USPC ..... 399/107–110, 113
See application file for complete search history.

(56) References Cited

U.S. PATENT DOCUMENTS 8,731,433 B2 * 5/2014 Kondo ..... G03G 21/1619 399/107
2014/0376956 A1 * 12/2014 Souda ..... G03G 21/1619 399/107

FOREIGN PATENT DOCUMENTS

JP 2015-073531 A 4/2012

* cited by examiner

*Primary Examiner* — Hoan Tran
(74) *Attorney, Agent, or Firm* — Studebaker & Brackett PC

(57) ABSTRACT

An image forming apparatus includes a lower unit, an upper unit, and a coupling section. The upper unit is disposed on the lower unit. The coupling section couples the upper unit to the lower unit. The lower unit includes a first vertical plate member. The first vertical plate member is disposed in a rear position in the lower unit along a rear surface of the lower unit. The upper unit includes a second vertical plate member. The second vertical plate member is disposed in a rear position in the upper unit along a rear surface of the upper unit. The coupling section includes a plurality of engagement sections and a mating engagement section that engages with the engagement sections. The engagement sections are arranged along and supported on the second vertical plate member. The mating engagement section is elongated along and supported on the first vertical plate member.

15 Claims, 9 Drawing Sheets

IMAGE FORMING APPARATUS

INCORPORATION BY REFERENCE

The present application claims priority under 35 U.S.C. § 119 to Japanese Patent Application No. 2016-089288, filed on Apr. 27, 2016. The contents of this application are incorporated herein by reference in their entirety.

BACKGROUND

The present disclosure relates to an image forming apparatus.

Some image forming apparatuses include a main unit, a sheet feed unit, and a coupling mechanism. The main unit is mounted on the sheet feed unit and coupled to the sheet teed unit by the coupling mechanism.

SUMMARY

An image forming apparatus according to an aspect of the present disclosure forms an image on a sheet and includes a lower unit, an upper unit, and a coupling section. The upper unit is disposed on the lower unit. The coupling section couples the upper unit to the lower unit. The lower unit includes a first vertical plate member. The first vertical plate member is disposed in a rear position in the lower unit along a rear surface of the lower unit. The upper unit includes a second vertical plate member. The second vertical plate member is disposed in a rear position in the upper unit along a rear surface of the upper unit. The coupling section includes a plurality of engagement sections and a mating engagement section that engages with the plurality of engagement sections. The plurality of engagement sections are arranged along and supported on one of the first vertical plate member and the second vertical plate member. The mating engagement section is elongated along and supported on the other of the first vertical plate member and the second vertical plate member.

DETAILED DESCRIPTION

Figure 1:
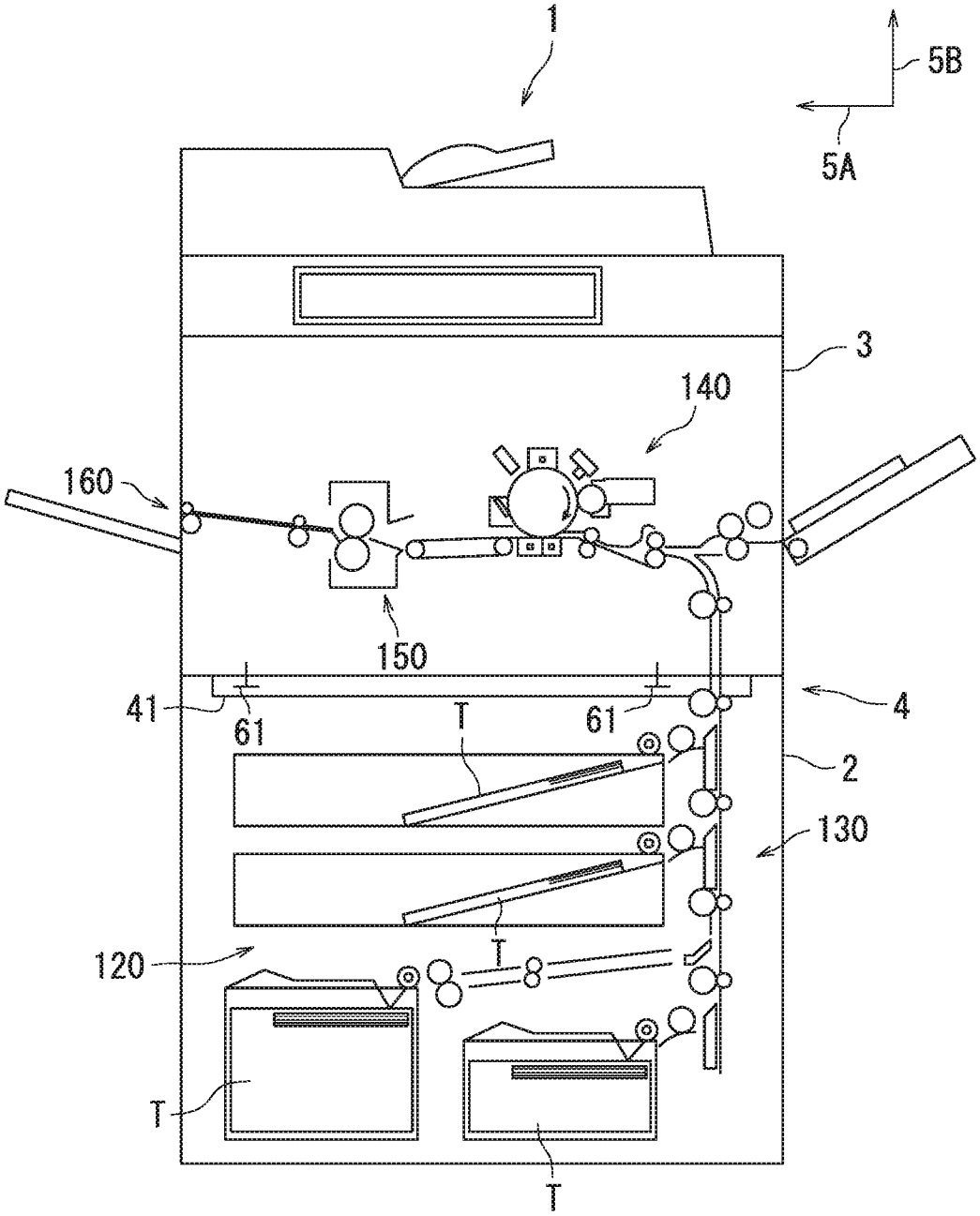
FIG. 1 is a diagram illustrating an image forming apparatus according to an embodiment of the present disclosure.

The following describes an embodiment of the present disclosure with reference to FIGS. 1 to 15. Elements that are the same or equivalent are indicated by the same reference signs in the drawings and description thereof is not repeated.

Figure 2:
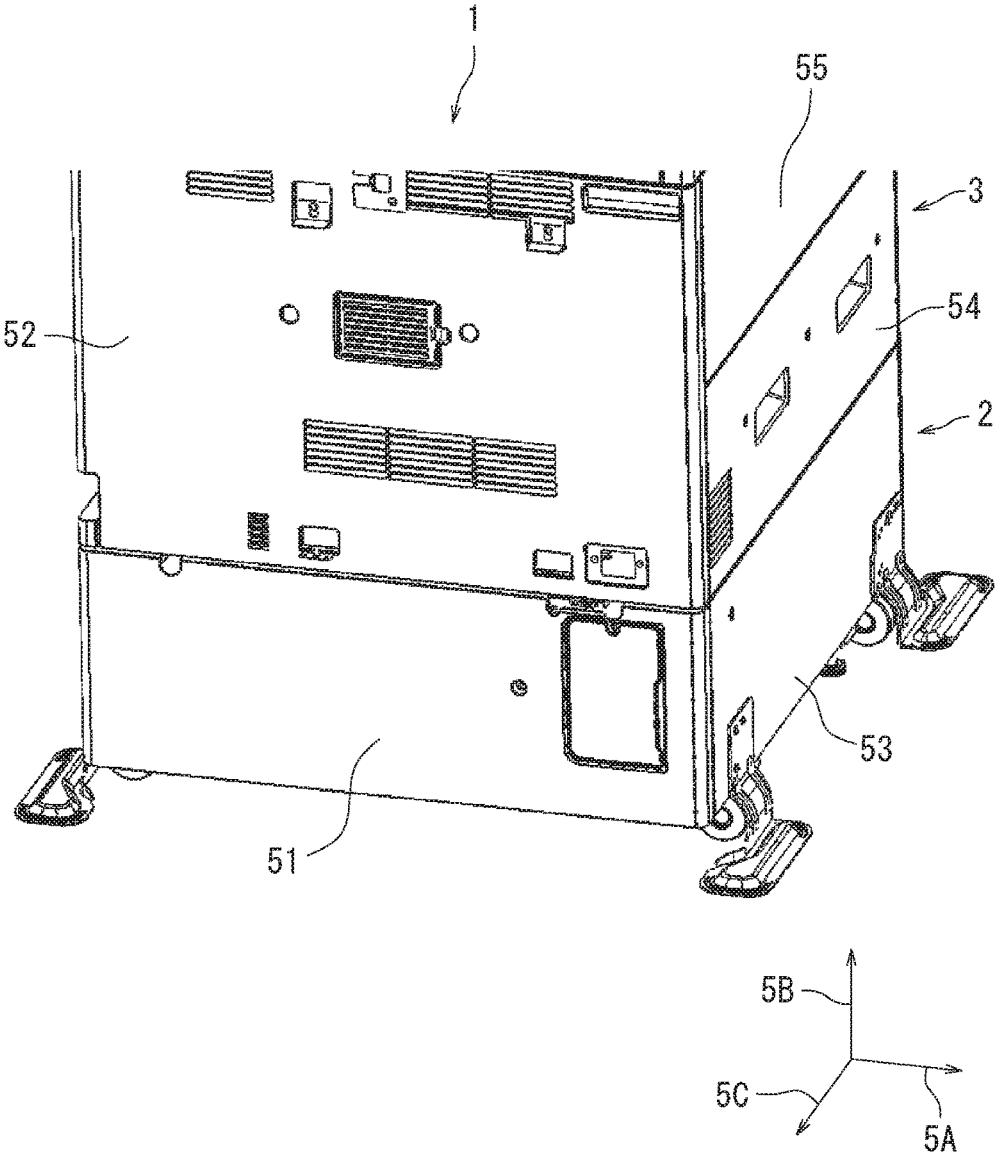
FIG. 2 is a diagram illustrating external appearance of a rear face of the image forming apparatus in FIG. 1.

The following describes a configuration of an image forming apparatus 1 according to an embodiment of the present disclosure with reference to FIGS. 1 and 2. FIG. 1 illustrates the image forming apparatus 1. FIG. 2 illustrates external appearance of a rear face of the image forming apparatus 1. The image forming apparatus 1 forms an image on a sheet T. The image forming apparatus 1 is for example a multifunction peripheral having a scan function, a copy function, a printing function, and a facsimile function.

As illustrated in FIG. 1, the image forming apparatus 1 includes a lower unit 2, an upper unit 3, and a coupling section 4. The upper unit 3 is located upward of the lower unit 2 in an upward direction 5B. The coupling section 4 couples the upper unit 3 to the lower unit 2. The coupling section 4 includes a moving member 41, which may be referred to as a mating engagement section, and first engaging sections 61, which may be referred to as engagement sections.

The lower unit 2 includes an accommodation section 120 and a portion of a conveyance section 130. The upper unit. 3 includes an image forming section 140, a fixing section 150, an ejection section 160, and another portion of the conveyance section 130 that is different from the portion of the conveyance section 130 included in the lower unit 2.

The accommodation section 120 accommodates a sheet T. The conveyance section 130 conveys the sheet T from the accommodation section 120 to the ejection section 160 through the image forming section 140 and the fixing section 150.

The image forming section 140 forms an image on the sheet T. The fixing section 150 applies heat and pressure onto the sheet T having the image formed thereon to fix the image to the sheet T. The ejection section 160 discharges the sheet T.

As illustrated in FIG. 2, a rear surface of the lower unit 2 is covered with a first rear plate 51, which is an exterior member. Left and right side surfaces of the lower unit 2 are covered with first side plates 53, which are exterior members. A rear surface of the upper unit 3 is covered with a second rear plate 52, which is an exterior member. Left and right side surfaces of the upper unit. 3 are covered with second side plates 54 and third side plates 55, which are exterior members.

Figure 3:
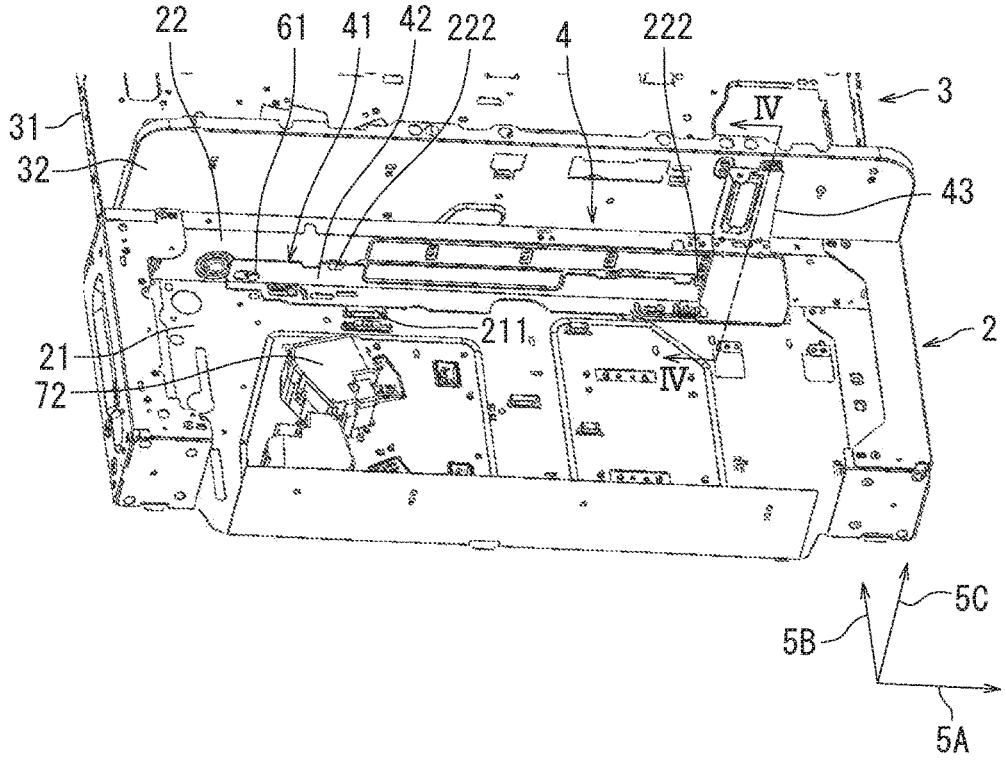
FIG. 3 is a diagram illustrating internal appearance of a rear portion of the image forming apparatus in FIG. 1.
Figure 4:
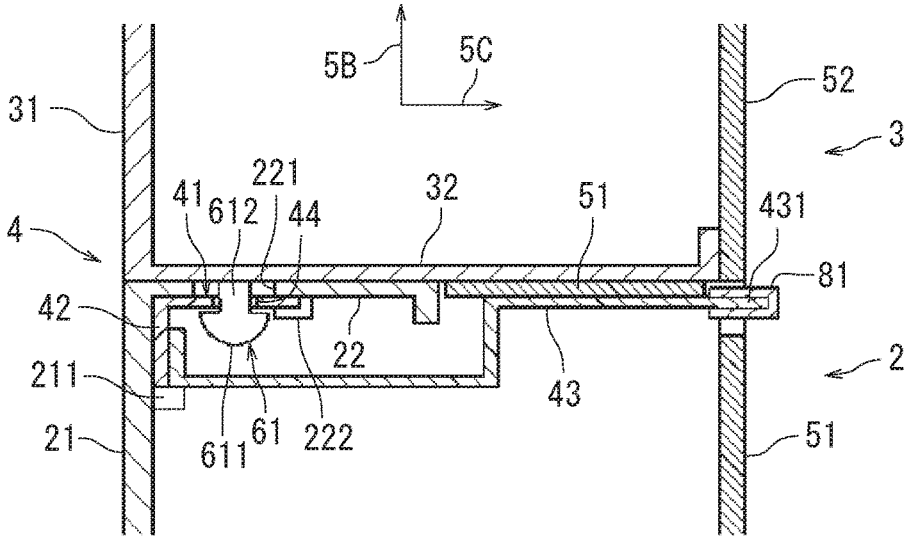
FIG. 4 is a diagram schematically illustrating a coupling section in FIG. 3.

The following describes the coupling section 4 with reference to FIGS. 3 and 4. FIG. 3 illustrates an internal structure of a rear portion of the image forming apparatus 1. FIG. 4 is a cross-sectional view, taken along line IV-IV in FIG. 3, illustrating the coupling section 4.

As illustrated in FIGS. 3 and 4, the lower unit 2 includes a first vertical plate member 1 and a first horizontal plate member 22. The first vertical plate member 21 has at least one projecting section 211. The first horizontal plate member 22 has a plurality of through holes 221 and a plurality of tongue sections 222. The plurality of through holes 221 are arranged along a leftward direction 5A in the first horizontal plate member 22. The upper unit 3 includes a second vertical plate member 31 and a second horizontal plate member 32.

The first vertical plate member 21 is disposed in a rear position in the lower unit 2 along the rear surface of the lower unit 2. More specifically, the first vertical plate member 21 has a main surface perpendicular to a rearward direction 5C and is located inward of the first rear plate 51 in the lower unit 2. The rear position in the lower unit 2 refers to a position located toward the rearward direction 5C relative to a central line of the lower unit 2 in the rearward direction 5C. The first horizontal plate member 22 is disposed at an upper edge of the first vertical plate member 21 in the upward direction 5B. Specifically, the first horizontal plate member 22 extends in the rearward direction 5C from the upper edge of the first vertical plate member 21 in the upward direction 5B. More specifically, the first vertical plate member 21 and the first horizontal plate member 22 are formed by bending a metal plate, which is a material of the first vertical plate member 21 and the first horizontal plate member 22, at a right angle.

The first vertical plate member 21 supports the moving member 41 and a motor 72. The motor 72 functions as a drive source for driving conveyance rollers of the conveyance section 130.

The moving member 41 is elongated along the first vertical plate member 21 and engages with the plurality of first engaging sections 61. More specifically, the moving member 41 is elongated along the leftward direction 5A. The moving member 41 is supported on the first vertical plate member 21 using the tongue sections 222 and the projecting section 211 while being in contact with the first vertical plate member 21 and the first horizontal plate member 22. The tongue sections 222 of the first horizontal plate member 22 are each a portion of the first horizontal plate member 22 that is cut and twisted in a downward direction. Note that the "downward direction" is a direction opposite to the upward direction 5B. The projecting section 211 projects in the rearward direction 5C from a rear surface of the first vertical plate member 21 in the rearward direction 5C.

The moving member 41 has a body section 42 and a protruding section 43. The body section 42 is a plate-like member elongated along the leftward direction 5A and having an L-shaped cross-section. The body section 42 has a plurality of slots 44 through which the respective first engaging sections 61 are inserted. The plurality of slots 44 are arranged along the leftward direction 5A in the body section 42. The plurality of slots 44 are in one-to-one correspondence with the through holes 221 of the first horizontal plate member 22.

The second vertical plate member 31 is disposed in a rear position in the upper unit 3 along the rear surface of the upper unit 3. Specifically, the second vertical plate member 31 has a main surface perpendicular to the rearward direction 5C and is located inward of the second rear plate 52 in the upper unit 3. The rear position in the upper unit 3 refers to a position located toward the rearward direction 5C relative to a central line of the lower unit 2 in the rearward direction 5C. The second vertical plate member 31 is stacked on top of the first vertical plate member 21 in the upward direction 5B. The second horizontal plate member 32 is disposed at a lower edge of the second vertical plate member 31 in the downward direction. Specifically, the second horizontal plate member 32 extends in the rearward direction 5C from the lower edge of the second vertical plate member 31. More specifically, the second vertical plate member 31 and the second horizontal plate member 32 are formed by bending a metal plate, which is a material of the second vertical plate member 31 and the second horizontal plate member 32, at a right angle.

The second vertical plate member 31 supports the plurality of first engaging sections 61. The plurality of first engaging sections 61 are arranged along the second vertical plate member 31. Specifically the plurality of first engaging sections 61 are arranged along the leftward direction 5A on the second vertical plate member 31.

The following describes the first engaging sections 61 with reference to FIG. 4. Each of the first engaging sections 61 is a shaft-like member having a large-diameter section 611 and a small-diameter section 612. The first engaging section 61 protrudes in the downward direction from a lower surface of the second horizontal plate member 32. The large-diameter section 611 is located on a distal end side of the first engaging section 61 in a protruding direction of the first engaging section 61. The small-diameter section 612 is located on a proximal end side of the first engaging section 61 in the protruding direction. The large-diameter section 611 engages with the body section 42 while the first engaging section 61 is in the corresponding through hole 221 and the corresponding slot 44.

As described above with reference to FIGS. 1 to 4, the plurality of first engaging sections 61 in the image forming apparatus 1 according to the present embodiment are arranged along the second vertical plate member 31 and supported on the second vertical plate member 31. Furthermore, the moving member 41 is elongated along the first vertical plate member 21 and supported on the first vertical plate member 21. The second vertical plate member 31 is coupled to the first vertical plate member 21, and thus the upper unit 3 is coupled to the lower unit 2 through engagement of the moving member 41 with the plurality of first engaging sections 61.

The first vertical plate member 21 is a member that supports the motor 72, which is heavy, and that is therefore stronger than the first side plates 53. Accordingly, coupling the second vertical plate member 31 to the first vertical plate member 21 enables stronger coupling of the upper unit 3 to the lower unit 2 than coupling the second side plates 54 to the first side plate 53 does. As a result, the image forming apparatus 1 according to the present embodiment can achieve stronger coupling of the upper unit 3 to the lower unit 2.

Furthermore, the moving member 41 in the image forming apparatus 1 according to the present embodiment engages with the plurality of first engaging sections 61 while being in contact with the first vertical plate member 21. Since the moving member 41 is in contact with the first vertical plate member 21, the plurality of first engaging sections 61 are disposed adjacent to the second vertical plate member 31. Accordingly, strong coupling of the second vertical plate member 31 to the first vertical plate member 21 can be achieved. As a result, the image forming apparatus 1 according to the present embodiment can achieve still stronger coupling of the upper unit 3 to the lower unit 2.

Furthermore, the moving member 41 in the image forming apparatus 1 according to the present embodiment includes the body section 42, and an upper surface of the body section 42 in the upward direction 5B is in contact with the first horizontal plate member 22. Accordingly, the body section 42, in conjunction with the first horizontal plate member 22, receives load in the upward direction 5B while the body section 42 is in engagement with the plurality of first engaging sections 61. As a result, the image forming apparatus 1 according to the present embodiment can achieve still stronger coupling of the upper unit 3 to the lower unit 2.

The following describes the coupling section 4 in more detail with reference to FIGS. 5 to 13.

Figure 5:
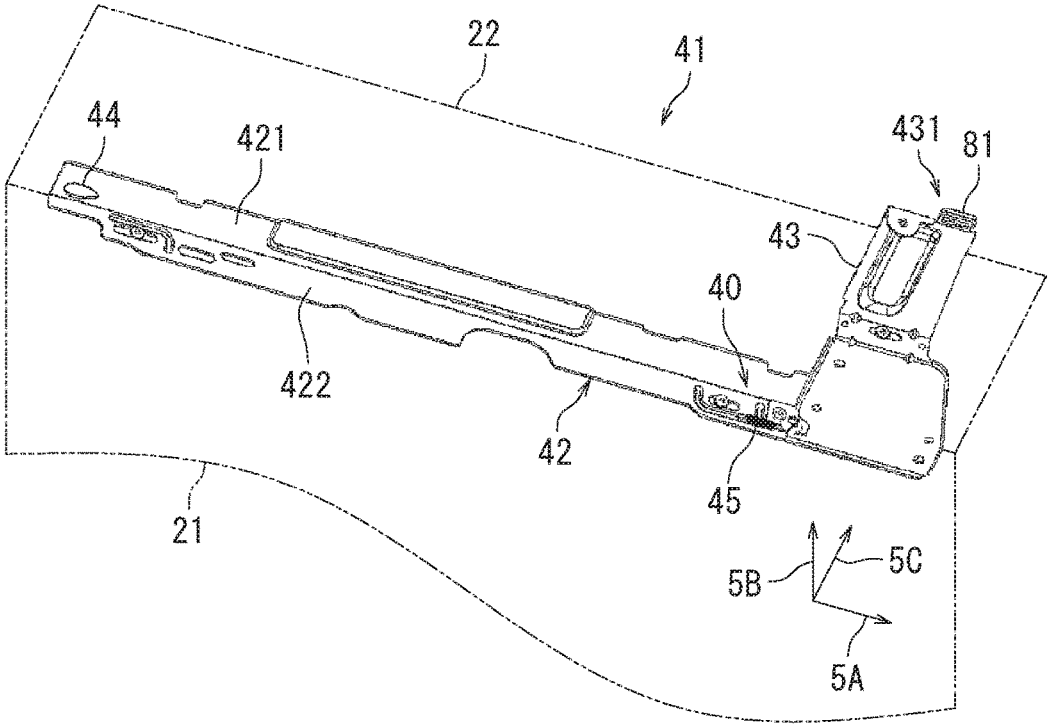
FIG. 5 is a diagram illustrating a biasing section.

As illustrated in FIG. 5, the coupling section 4 includes a biasing section 40 in addition to the moving member 41. The following describes the biasing section 40 with reference to FIG. 5. FIG. 5 is a diagram illustrating the biasing section 40. Note that in the following description, a leftward direction, an upward direction, and a rearward direction with respect to the moving member 41 are defined based on the orientation of the moving member 41 attached to the image forming apparatus 1. Accordingly, the leftward direction, the upward direction, and the rearward direction with respect to the moving member 41 respectively agree with the leftward direction 5A, the upward direction 5B, and the rearward direction 5C with respect to the image forming apparatus 1.

As illustrated in FIG. 5, the body section 42 of the moving member 41 includes a horizontal section 421 and a vertical section 422. The horizontal section 421 is an elongated plate-like member in parallel to the first horizontal plate member 22. The vertical section 422 is an elongated plate-like member in parallel to the first vertical plate member 21. A proximal section of the protruding section 43 in a protruding direction is attached to the vertical section 422. An operation section 81 is attached to a distal section 431 of the protruding section 43 in the protruding direction.

As illustrated in FIG. 5, the biasing section 40 includes a spring 45. The spring 45 is disposed along the leftward direction 5A at a location in the vicinity of the vertical section 422. A left end of the spring 45 in the leftward direction 5A is coupled to the proximal section of the protruding section 43, and a right end thereof is coupled to the first vertical plate member 21 while the spring 45 is in a stretched state. Accordingly, the moving member 41 is biased in the rightward direction by resilient force of the spring 45. Note that the "rightward direction" is a direction opposite to the leftward direction 5A. The moving member 41 is movable between an engagement position where the moving member 41 engages with the plurality of first engaging sections 61 and a disengagement position where the moving member 41 disengages from the plurality of first engaging sections 61, along the first vertical plate member 21. More specifically, the moving member 41 is movable along the leftward direction 5A. The engagement position is located rightward of the disengagement position. That is, the spring 45 biases the moving member 41 toward the engagement position.

As described above with reference to FIG. 5, the biasing section 40 in the image forming apparatus 1 according to the present embodiment biases the moving member 41 toward the engagement position. Accordingly, once both the large-diameter section 611 and the small-diameter section 612 of each first engaging section 61 are inserted through the corresponding slot 44, the biasing force of the biasing section 40 moves the moving member 41 to the engagement position. Thus, the image forming apparatus 1 according to the present embodiment can enable easy coupling of the upper unit 3 to the lower unit 2.

Figure 6:
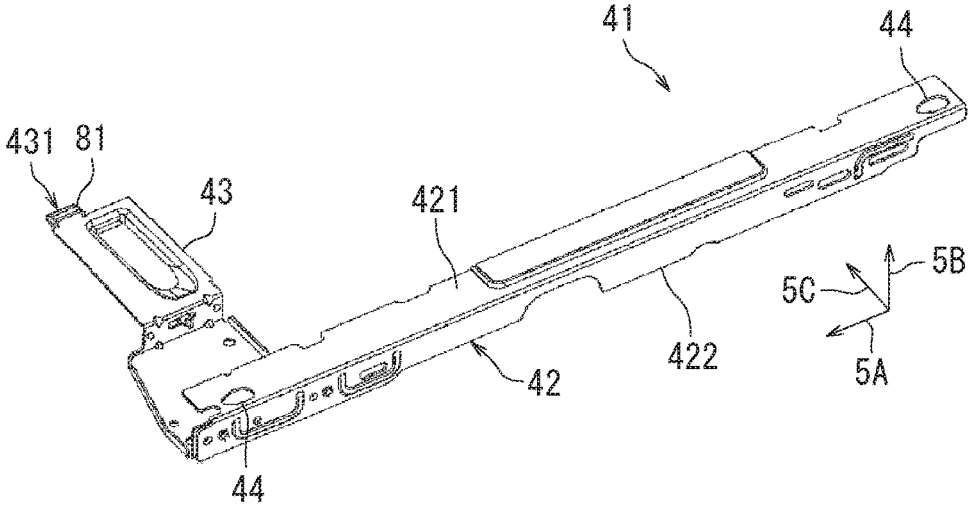
FIG. 6 is a diagram illustrating a moving member in FIG. 3.
Figure 7:
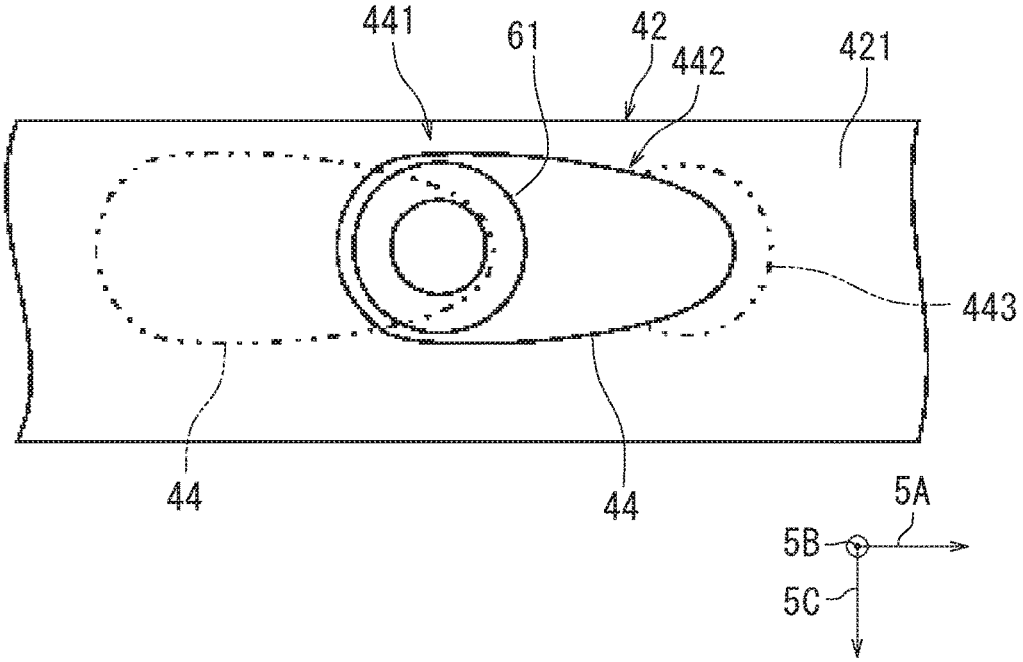
FIG. 7 is an enlarged view illustrating a portion of the moving member in FIG. 3.

The following describes the moving member 41 in more detail with reference to FIGS. 6 and 7. FIG. 6 is a diagram illustrating the moving member 41. FIG. 7 is an enlarged view of a portion of the body section 42 as viewed from above in the upward direction 5B.

As illustrated in FIGS. 6 and 7, each slot 44 has a shape elongated along the leftward direction 5A. The slot 44 has a wider section 441 and a narrower section 442. The narrower section 442 is located leftward of the wider section 441 in the leftward direction 5A. In a direction perpendicular to the direction of the elongation of the slot 44, the narrower section 442 has shorter lengths than the wider section 441.

The wider section 441 has a shape that allows the large-diameter section 611 of the corresponding first engaging section 61 to be inserted therethrough. A solid line in FIG. 7 represents the slot 44 when the moving member 41 is in the disengagement position. When the moving member 41 is in the disengagement position, the wider section 441 of the slot 44 and the corresponding first engaging section 61 overlap in the upward direction 5B. Accordingly, when the moving member 41 is in the disengagement position, the first engaging section 61 can be pulled out of the slot 44. Thus, the moving member 41 disengages from the plurality of first engaging sections 61.

The narrower section 442 has a shape that allows the small-diameter section 612 to be inserted therethrough and that does not allow the large-diameter section 611 to be inserted therethrough. A dashed and double dotted line in FIG. 7 represents the slot 44 when the moving member 41 is in the engagement position. When the moving member 41 is in the engagement position, the narrower section 442 and the corresponding first engaging section 61 overlap in the upward direction 5B. Accordingly, when the moving member 41 is in the engagement position, the first engaging sections 61 cannot be pulled out of the slots 44. Thus, the moving member 41 engages with the plurality of first engaging sections 61. More specifically, when the moving member 41 is in the engagement position, a surrounding section 443 of the moving member 41 that surrounds the narrower section 442 of each slot 44 engages with the large-diameter section 611 of the corresponding first engaging section 61.

As illustrated in FIGS. 6 and 7, a central line of the slot 44 in a width direction thereof is located frontward of a central line of the horizontal section 421 in a width direction thereof. The width direction of the slot 44 is in parallel to the rearward direction 5C. The "frontward direction" is a direction opposite to the rearward direction 5C.

As described above with reference to FIGS. 6 and 7, each slot 44 is provided in the image forming apparatus 1 according to the present embodiment such that the central line thereof in the width direction is located frontward of the central line of the horizontal section 421 in the width direction. Such a configuration allows each surrounding section 443 to be located toward the first vertical plate member 21. Since the surrounding sections 443 are located toward the first vertical plate member 21, the first engaging sections 61 are located toward the second vertical plate member 31. As a result, the image forming apparatus 1 according to the present embodiment can achieve still stronger coupling of the upper unit 3 to the lower unit 2.

Figure 8:
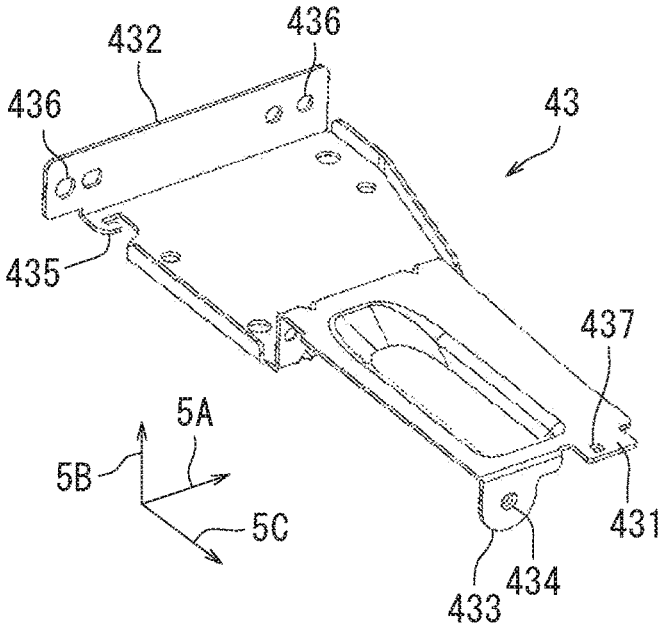
FIG. 8 is a diagram illustrating a protruding section in FIG. 3.
Figure 9:
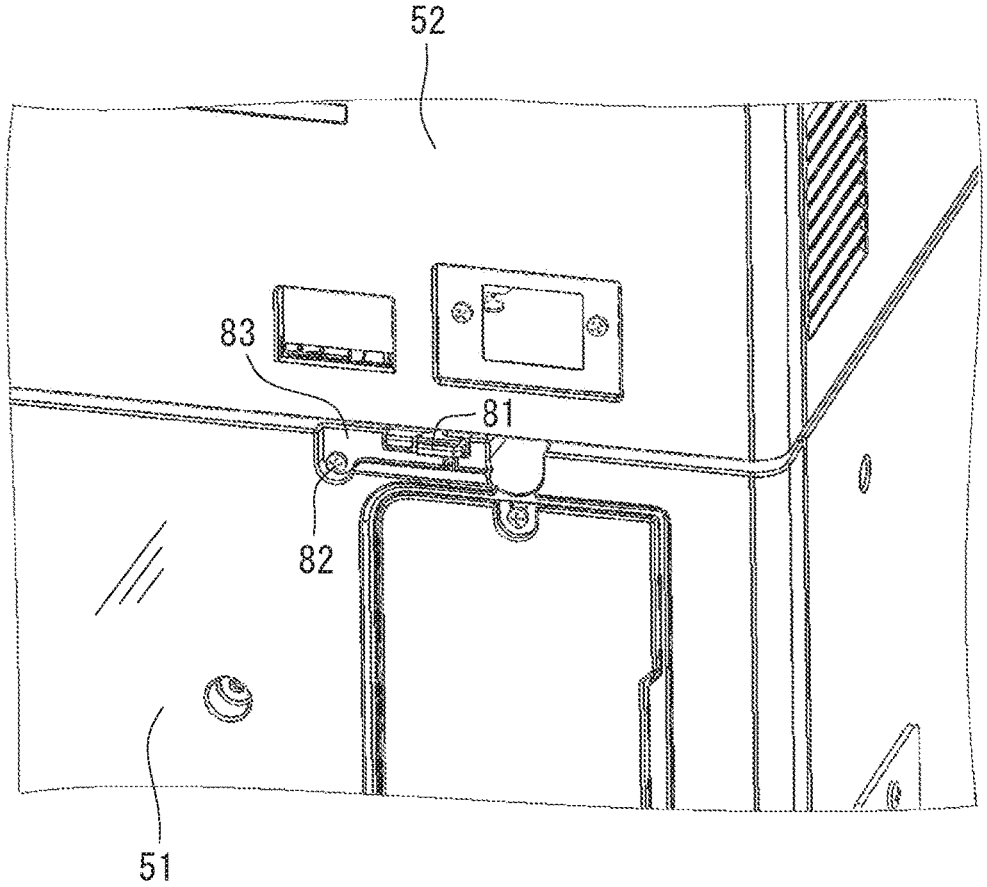
FIG. 9 is an enlarged view of a portion of a rear face of the image forming apparatus in FIG. 1.

The following describes the protruding section 43 with reference to FIGS. 8 and 9. FIG. 8 illustrates the protruding section 43. As illustrated in FIG. 8, the protruding section 43 has the distal section 431, a first bent section 432, a second bent section 433, a screw hole 434, a spring coupling section 435, a plurality of screw insertion holes 436, and a recess 437.

The distal section 431 is a portion of the protruding section 43 on a distal end side thereof in the protruding direction. The operation section 81 is attached to the distal section 431. The first bent section 432 is formed by bending, in the upward direction 5B, a portion of the proximal section of the protruding section 43 in the protruding direction. The second bent section 433 is a portion formed by bending downward a rightward portion of the distal section 431 of the protruding section 43 in the protruding direction. The screw hole 434 is a hole formed through the second bent section 433 along the rearward direction 5C. The spring coupling section 435 is located in the proximal section of the protruding section 43 in the protruding direction and is coupled to the left end of the spring 45 in the leftward direction 5A. The screw insertion holes 436 are each a hole formed through the first bent section 432 along the rearward direction 5C. The protruding section 43 is fixed to the body section 42 with screws inserted into the screw insertion holes 436. The recess 437 is formed in an upper surface of the distal section 431 in the upward direction 5B.

FIG. 9 is an enlarged view of a portion of a rear face of the image forming apparatus 1. As illustrated in FIG. 9, the first rear plate 51 has a recessed section 83 at an upper end thereof in the upward direction 5B. As a result of the protruding section 43 protruding in the rearward direction 5C from the body section 42 elongated along the leftward direction 5A, the operation section 81 protrudes from a bottom surface of the recessed section 83 externally to the lower unit 2.

As described above with reference to FIGS. 8 and 9, the moving member 41 in the image forming apparatus 1 according to the present embodiment has the protruding section 43 protruding in the rearward direction 5C from the body section 42. The operation section 81 is attached to the distal section 431 of the protruding section 43. The operation section 81 protrudes from the first rear plate 51 externally to the lower unit 2. Accordingly, the moving member 41 can be moved between the engagement position and the disengagement position through operation of the operation section 81 from outside of the first rear plate 51. Thus, the image forming apparatus 1 according to the present embodiment can enable easy coupling of the upper unit 3 to the lower unit 2 and easy decoupling of the upper unit 3 from the lower unit 2.

Furthermore, the operation section 81 in the image forming apparatus 1 according to the present embodiment is located on a rear surface side of the image forming apparatus 1. The image forming apparatus 1 according to the present embodiment can therefore prevent the operation section 81 from being mistakenly operated, and thus can prevent the upper unit 3 from being mistakenly decoupled from the lower unit 2.

Figure 10:
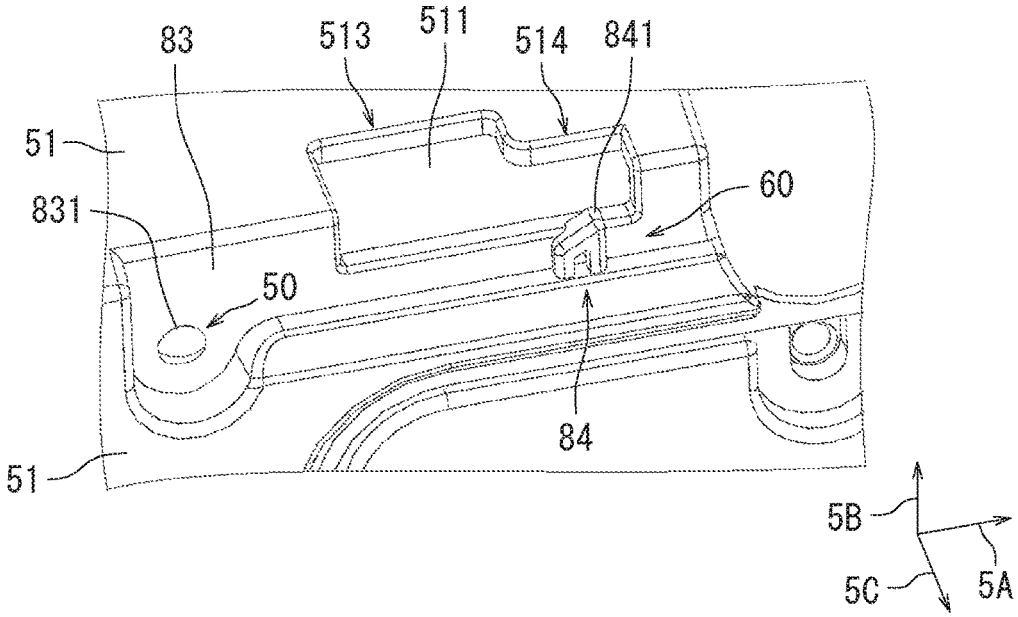
FIG. 10 is a diagram illustrating a securing section.
Figure 11:
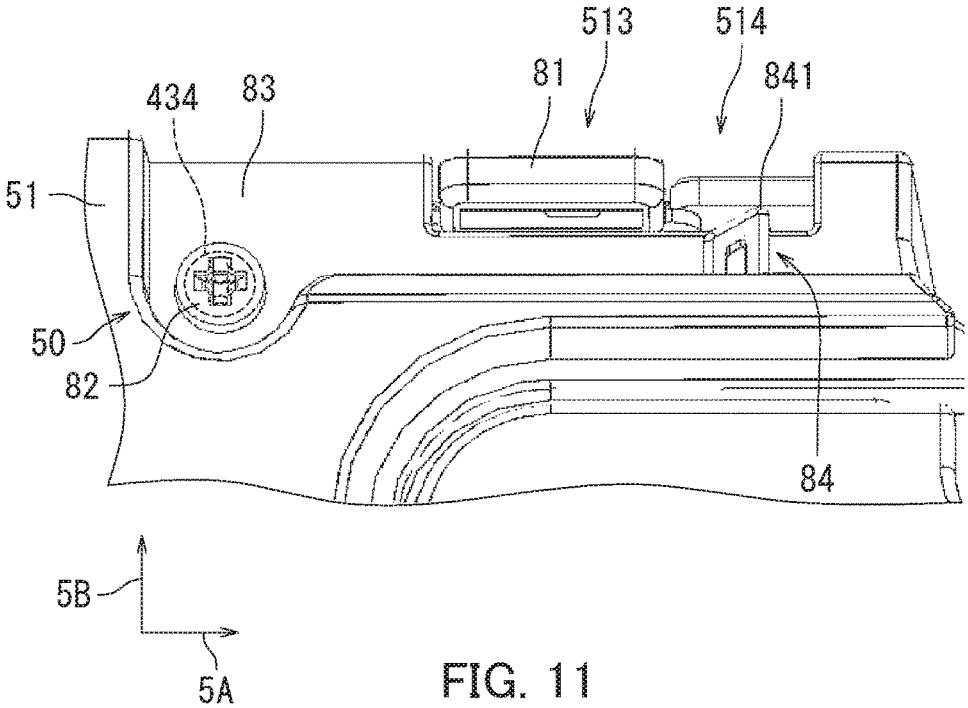
FIG. 11 is a diagram illustrating the securing section.

The following describes a securing section 50 with reference to FIGS. 10 and 11. The securing section 50 is included in the coupling section 4. FIGS. 10 and 11 each illustrate the securing section 50.

As illustrated in FIGS. 10 and 11, the first rear plate 51 has an operation opening 511. The operation opening 511 is located at an upper end of the recessed section 83 in the upward direction 5B. The operation opening 511 has a wider right-hand section 5B and a narrower left-hand section 514. The left-hand section 514 is located leftward of the right-hand section 5B in the leftward direction 5A. The operation section 81 moves between the right-hand section 5B and the left-hand section 514 along the leftward direction 5A as the moving member 41 moves between the engagement position and the disengagement position. Furthermore, the recessed section 83 has a second engaging section 84 and a screw insertion hole 831. The second engaging section 84 has an upper section 841 in the upward direction 5B protruding in the upward direction 5B from a lower end of the operation opening 511.

The securing section 50 includes a screw 82, the screw hole 434, and the screw insertion hole 831. When the operation section 81 is in the right-hand section 5B, the moving member 41 is in the engagement position. When the moving member 41 is in the engagement position, the screw 82 is screwed onto the screw hole 434 of the protruding section 43 through the screw insertion hole 831. As a result of the screw 82 being screwed onto the screw hole 434, the moving member 41 is secured in the engagement position.

As described above with reference to FIGS. 10 and 11, the securing section 50 in the image forming apparatus 1 according to the present embodiment secures the moving member 41 in the engagement position. The image forming apparatus 1 according to the present embodiment can therefore prevent the upper unit 3 from being decoupled from the lower unit 2 due to an unintended operation of the operation section 81.

Figure 12:
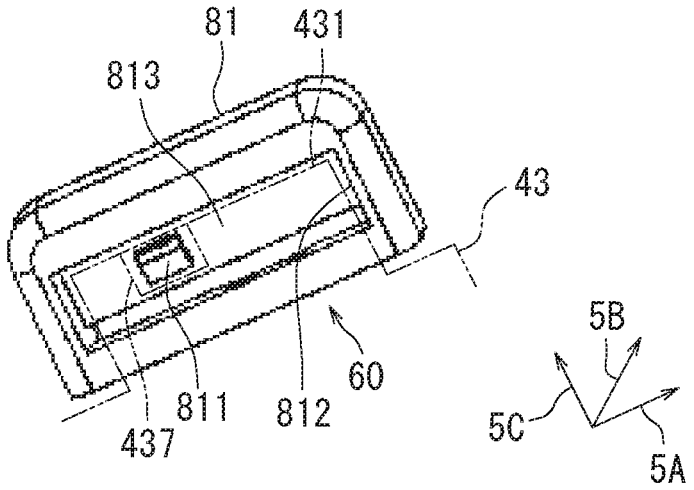
FIG. 12 is a diagram illustrating a retaining section.
Figure 13:
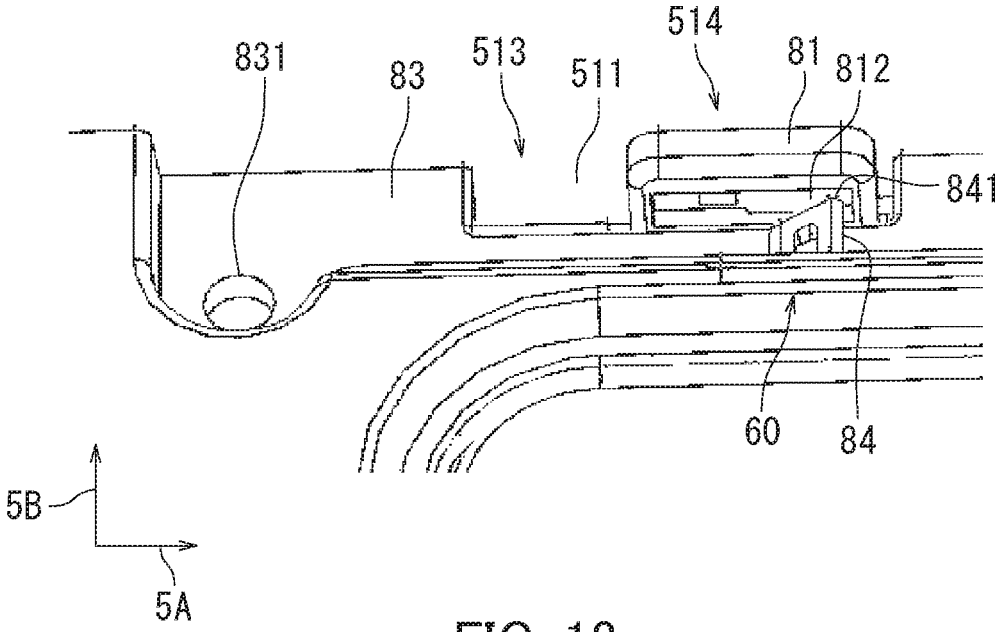
FIG. 13 is a diagram illustrating the retaining section.

The following describes a retaining section 60 with reference to FIGS. 12 and 13. The retaining section 60 is included in the coupling section 4. FIGS. 12 and 13 each illustrate the retaining section 60.

As illustrated in FIG. 12, the operation section 81 is a thin rectangular parallelepiped member having a hollow 813. The operation section 81 has a rectangular cutout 812 in a lower wall of the hollow 813. The hollow 813 is in communication with the outside of the operation section 81 through the cutout 812.

The hollow 813 is a space for accommodating the distal section 431 of the protruding section 43. The distal section 431 is inserted into the hollow 813 through an opening provided at a front face of the operation section 81. The operation section 81 further has a projection 811. The projection 811 projects toward the inside of the hollow 813 from an upper wall of the hollow 813 in the upward direction 5B. The projection 811 engages with the recess 437 of the protruding section 43.

As illustrated in FIG. 13, the retaining section 60 includes the second engaging section 84 and the cutout 812. When the moving member 41 is in the disengagement position, the operation section 81 is in the left-hand section 514. When the operation section 81 is in the left-hand section 514, the upper section 841 of the second engaging section 84 is fitted into the cutout 812. As a result of the upper section 841 being fitted into the cutout 812, the second engaging section 84 engages with walls of the cutout 812, thereby retaining the moving member 41 in the disengagement position.

As described above with reference to FIGS. 12 and 13, the retaining section 60 in the image forming apparatus 1 according to the present embodiment retains the moving member 41 in the disengagement position. Accordingly, the moving member 41 is retained in the disengagement position against the resilient force of the spring 45 when the upper unit 3 is decoupled from the lower unit 2, and subsequently the upper unit 3 is detached from the lower unit 2. Thus, the image forming apparatus 1 according to the present embodiment can enable easy detachment of the upper unit 3 from the lower unit 2.

Figure 14:
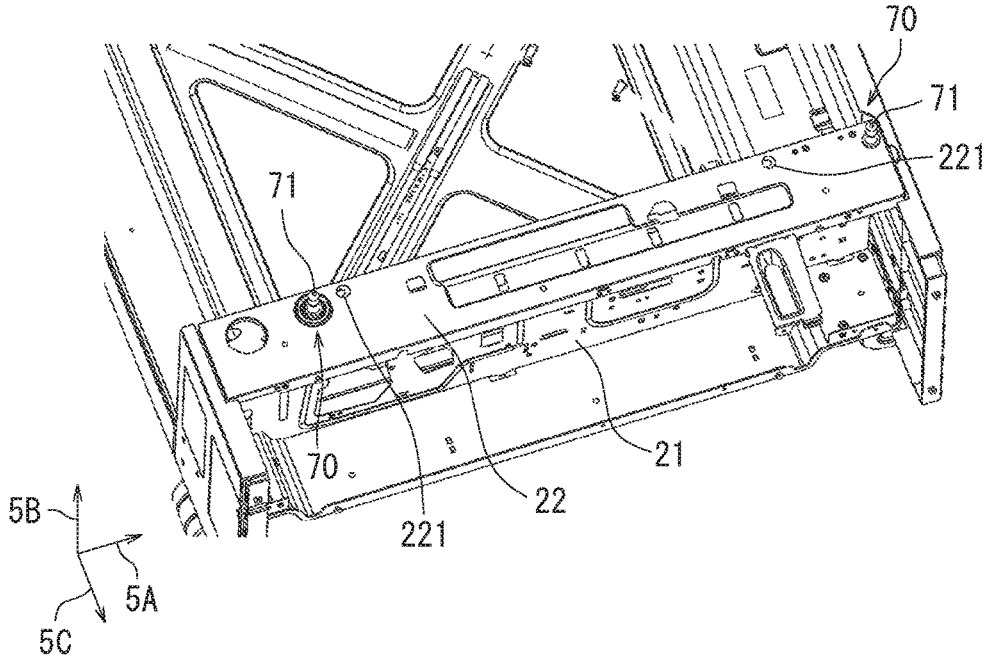
FIG. 14 is a diagram illustrating a positioning section.
Figure 15:
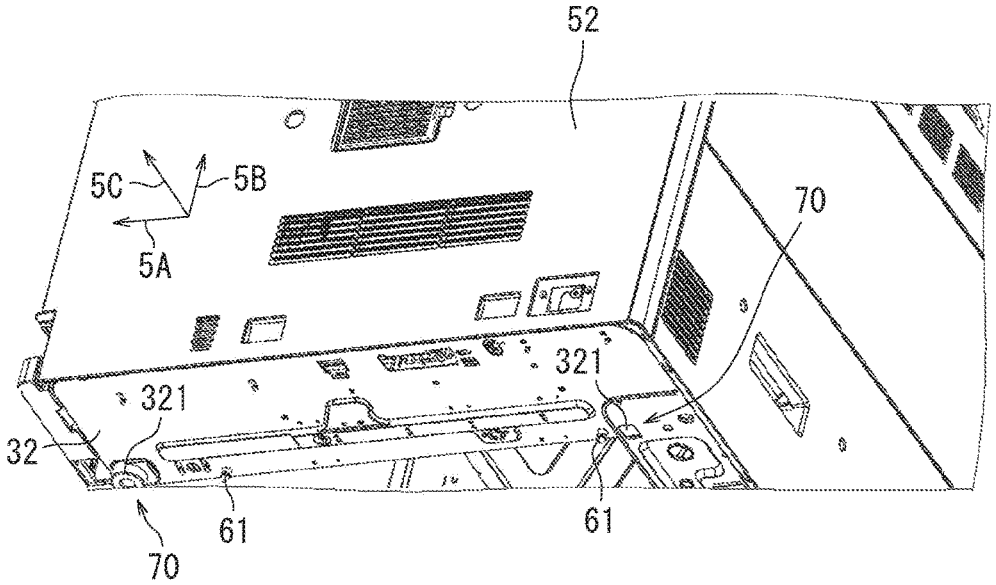
FIG. 15 is a diagram illustrating the positioning section.

The following describes a positioning section 70 with reference to FIGS. 14 and 15. The positioning section 70 is included in the coupling section 4. FIGS. 14 and 15 each illustrate the positioning section 70.

As illustrated in FIG. 14, the positioning section 70 includes projections 71. The projections 71 protrude in the upward direction 5B from an upper surface of the first horizontal plate member 22.

As illustrated in FIG. 15, the positioning section 70 includes mating holes 321. The projections 71 mate with the respective mating holes 321. As a result of the projections 71 mating with the respective mating holes 321, the upper unit 3 and the lower unit 2 are positioned relative to each other with the moving member 41 in engagement with the plurality of first engaging sections 61.

As described above with reference to FIGS. 14 and 15, the positioning section 70 in the image forming apparatus 1 according to the present embodiment positions the upper unit 3 and the lower unit 2 relative to each other. Thus, the upper unit 3 can be coupled to the lower unit 2 with high position accuracy.

An embodiment of the present disclosure has been described above with reference to the drawings (FIGS. 1 to 15). According to the image forming apparatus 1 of the present embodiment, the coupling section 4 couples the second vertical plate member 31 to the first vertical plate member 21 and thereby couples the upper unit 3 to the lower unit 2. Thus, stronger coupling of the upper unit 3 to the lower unit 2 can be achieved.

However, the present disclosure is not limited to the above embodiment and may be implemented in various different forms that do not deviate from the essence of the present disclosure (for example, as described below in sections (1)-(5)). The drawings schematically illustrate elements of configuration in order to facilitate understanding and properties of elements of configuration illustrated in the drawings, such as thickness, length, and number thereof, may differ from actual properties thereof in order to facilitate preparation of the drawings. Furthermore, properties of elements of configuration described in the above embodiment, such as shapes and dimensions, are merely examples and are not intended as specific limitations. Various alterations may be made so long as there is no substantial deviation from the effects of the present disclosure.

(1) In the above-described embodiment of the present disclosure, the moving member 41 is supported on the first vertical plate member 21. However, the present disclosure is not limited to such an embodiment. The moving member 41 may be supported on the second vertical plate member 31. That is, the moving member 41 is disposed along one of the first vertical plate member 21 and the second vertical plate member 31. According to a configuration in which the moving member 41 is supported on the second vertical plate member 31, the first engaging sections 61 may be supported on the first vertical plate member 21. That is, the first engaging sections 61 are disposed along one of the first vertical plate member 21 and the second vertical plate member 31.

(2) In the above-described embodiment of the present disclosure, the moving member 41 is equivalent to the first mating engagement section. However, the present disclosure is not limited to such an embodiment. The moving member 41 may include the first engaging sections 61. According to a configuration in which the moving member 41 includes the first engaging sections 61, the first mating engagement section may for example be disposed on the second horizontal plate member 32.

(3) in the above-described embodiment of the present disclosure, the operation section 81 is disposed on the rear surface side of the image forming apparatus 1. However, the present disclosure is not limited to such an embodiment. The operation section 81 may be disposed on any of the right and left side plates of the image forming apparatus 1. In a configuration in which the operation section 81 is disposed on one of the side plates of the image forming apparatus 1, however, it is preferable to provide a mechanism for preventing unintended operation of the operation section 81.

(4) In the above-described embodiment of the present disclosure, the lower unit 2 includes the accommodation section 120. That is, the lower unit 2 functions as a sheet feed unit. However, the present disclosure is not limited to such an embodiment. The lower unit 2 may be any unit other than the sheet feed unit so long as the upper unit 3 can be coupled to the unit using the coupling section 4.

(5) In the above-described embodiment of the present disclosure, the first vertical plate member 21 and the first horizontal plate member 22 are formed by bending a metal plate, which is a material of the first vertical plate member 21 and the first horizontal plate member 22, at a right angle. However, the present disclosure is not limited to such an embodiment. The first vertical plate member 21 and the first horizontal plate member 22 may be separate members that are each formed from a metal plate and that are fastened to each other through a screw or welding. Likewise, the second vertical plate member 31 and the second horizontal plate member 32 are formed by bending a metal plate, which is a material of the second vertical plate member 31 and the second horizontal plate member 32, at a right angle. However, the present disclosure is not limited to such an embodiment. The second vertical plate member 31 and the second horizontal plate member 32 may be separate members that are each formed from a metal plate and that are fastened to each other through a screw or welding.

What is claimed is:

1. An image forming apparatus for forming an image on a sheet, comprising:

a lower unit;

an upper unit configured to be disposed on the lower unit; and a coupling section configured to couple the upper unit to the lower unit, wherein the lower unit includes a first vertical plate member disposed in a rear position in the lower unit along a rear surface of the lower unit, the upper unit includes a second vertical plate member disposed in a rear position in the upper unit along a rear surface of the upper unit, the coupling section includes:

a plurality of engagement sections arranged along and supported on one of the first vertical plate member and the second vertical plate member; and a mating engagement section configured to engage with the plurality of engagement sections, the mating engagement section being elongated along and supported on the other of the first vertical plate member and the second vertical plate member, the mating engagement section is movable between an engagement position where the mating engagement section engages with the plurality of engagement sections and a disengagement position where the mating engagement section disengages from the plurality of engagement sections, along the other of the first vertical plate member and the second vertical plate member, and the coupling section further includes a biasing section configured to bias the mating engagement section toward the engagement position.

2. The image forming apparatus according to claim 1, wherein the mating engagement section engages with the plurality of engagement sections while being in contact with the other of the first vertical plate member and the second vertical plate member.

3. The image forming apparatus according to claim 1, wherein the coupling section further includes a securing section configured to secure the mating engagement section in the engagement position.

4. The image forming apparatus according to claim 1, wherein the coupling section further includes a retaining section configured to retain the mating engagement section in the disengagement position.

5. An image forming apparatus for forming an image on a sheet, comprising:

a lower unit;

an upper unit configured to be disposed on the lower unit; and a coupling section configured to couple the upper unit to the lower unit, wherein the lower unit includes a first vertical plate member disposed in a rear position in the lower unit along a rear surface of the lower unit, the upper unit includes a second vertical plate member disposed in a rear position in the upper unit along a rear surface of the upper unit, the coupling section includes:

a plurality of engagement sections arranged along and supported on one of the first vertical plate member and the second vertical plate member; and a mating engagement section configured to engage with the plurality of engagement sections, the mating engagement section being elongated along and supported on the other of the first vertical plate member and the second vertical plate member, and the mating engagement section includes:

a body section elongated along the other of the first vertical plate member and the second vertical plate member; and a protruding section protruding rearward from the body section.

6. The image forming apparatus according to claim 5, wherein each of the plurality of engagement sections is a protrusion having a large-diameter section and a small-diameter section, the large-diameter section is located on a distal end side of the engagement section in a protruding direction of the engagement section, the small-diameter section is located on a proximal end side of the engagement section in the protruding direction, and the large-diameter section engages with the body section of the mating engagement section.

7. The image forming apparatus according to claim 6, wherein the mating engagement section is movable between an engagement position where the mating engagement section engages with the plurality of engagement sections and a disengagement position where the mating engagement section disengages from the plurality of engagement sections, along the other of the first vertical plate member and the second vertical plate member, the body section has a plurality of slots through which the respective engagement sections are inserted, each of the slots is elongated along a direction of the elongation of the body section, the slot has a wider section and a narrower section, in a direction perpendicular to the direction of the elongation of the slot, the narrower section has shorter lengths than the wider section, the wider section has a shape that allows the large-diameter section of the corresponding engagement section to be inserted therethrough, and the wider section of the slot and the corresponding engagement section overlap when the mating engagement section is in the disengagement position.

8. The image forming apparatus according to claim 7, wherein the narrower section allows the small-diameter section of the corresponding engagement section to be inserted therethrough and does not allow the large-diameter section of the corresponding engagement section to be inserted therethrough, and the narrower section and the corresponding engagement section overlap when the mating engagement section is in the engagement position.

9. The image forming apparatus according to claim 5, wherein the mating engagement section is movable between an engagement position where the mating engagement section engages with the plurality of engagement sections and a disengagement position where the mating engagement section disengages from the plurality of engagement sections, along the other of the first vertical plate member and the second vertical plate member, and the coupling section further includes a biasing section configured to bias the mating engagement section toward the engagement position.

10. The image forming apparatus according to claim 9, wherein the coupling section further includes a securing section configured to secure the mating engagement section in the engagement position.

11. The image forming apparatus according to claim 9, wherein the coupling section further includes a retaining section configured to retain the mating engagement section in the disengagement position.

12. An image forming apparatus for forming an image on a sheet, comprising:

a lower unit;

an upper unit configured to be disposed on the lower unit; and a coupling section configured to couple the upper unit to the lower unit, wherein the lower unit includes a first vertical plate member disposed in a rear position in the lower unit along a rear surface of the lower unit, the upper unit includes a second vertical plate member disposed in a rear position in the upper unit along a rear surface of the upper unit, the coupling section includes:

a plurality of engagement sections arranged along and supported on one of the first vertical plate member and the second vertical plate member; and a mating engagement section configured to engage with the plurality of engagement sections, the mating engagement section being elongated along and supported on the other of the first vertical plate member and the second vertical plate member, and the coupling section further includes a positioning section configured to position the upper unit and the lower unit relative to each other.

13. The image forming apparatus according to claim 12, wherein the mating engagement section is movable between an engagement position where the mating engagement section engages with the plurality of engagement sections and a disengagement position where the mating engagement section disengages from the plurality of engagement sections, along the other of the first vertical plate member and the second vertical plate member, and the coupling section further includes a biasing section configured to bias the mating engagement section toward the engagement position.

14. The image forming apparatus according to claim 13, wherein the coupling section further includes a securing section configured to secure the mating engagement section in the engagement position.

15. The image forming apparatus according to claim 13, wherein the coupling section further includes a retaining section configured to retain the mating engagement section in the disengagement position.

* * * * *